US006645582B2

(12) United States Patent
Sadasivan et al.

(10) Patent No.: US 6,645,582 B2
(45) **Date of Patent: *Nov. 11, 2003**

(54) INK JET RECORDING ELEMENT

(75) Inventors: Sridhar Sadasivan, Rochester, NY (US); Elizabeth A. Gallo, Penfield, NY (US); Lixin Chu, Rochester, NY (US); John M. Baier, Fairport, NY (US); David E. Decker, Rochester, NY (US); Xiaoru E. Wang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 13 days.

This patent is subject to a terminal disclaimer.

(21) Appl. No.: 09/944,547

(22) Filed: Aug. 31, 2001

(65) Prior Publication Data

US 2003/0064204 A1 Apr. 3, 2003

(51) Int. Cl.[7] ..... B41M 5/40

(52) U.S. Cl. ..... 428/32.34; 428/32.35; 428/32.36; 428/32.37

(58) Field of Search ..... 428/323, 327, 428/328, 329, 331, 500, 522, 32.34, 32.35, 32.36, 32.37

(56) References Cited

U.S. PATENT DOCUMENTS 5,747,146 A * 5/1998 Kashiwazaki et al. ..... 428/206
6,096,469 A * 8/2000 Anderson et al. ..... 430/119
6,197,381 B1 3/2001 Saito et al.
6,447,111 B1 * 9/2002 Gallo et al. ..... 347/101

FOREIGN PATENT DOCUMENTS

EP 813 978 12/1997

OTHER PUBLICATIONS

IS&Ts NIP 14: 1998 International Conference on Digital Printing Technologies; Kenzo Kasahara; "A New Quick–Drying, High–Water–Resistant Glossy Ink Jet Paper"; pp. 150–152.

* cited by examiner

*Primary Examiner*—Cynthia H. Kelly
*Assistant Examiner*—B. Shewareged
(74) *Attorney, Agent, or Firm*—Harold E. Cole

(57) ABSTRACT

A porous ink jet recording element having a support having thereon an image-receiving layer having: (a) inorganic particles having a primary particle size of from about 7 to about 40 nm in diameter which may be aggregated up to about 500 nm; (b) colloidal particles having a mean particle size of from about 20 to about 500 nm; (c) water-insoluble, cationic, polymeric particles having at least about 20 mole percent of a cationic mordant moiety; and (d) inorganic particles encapsulated with an organic polymer having a Tg of less than about 100° C.

20 Claims, No Drawings

INK JET RECORDING ELEMENT

CROSS REFERENCE TO RELATED APPLICATIONS

Reference is made to commonly assigned, U.S. patent applications and U.S. Patents:

U.S. Pat. No, 6,447,111 by Gallo et al., granted Sep. 10, 2002 herewith entitled "Ink Jet Printing Method";

Ser. No. 09/944,618 by Sadasivan et al., filed Aug. 31, 2001 herewith entitled "Ink Jet Recording Element"; U.S. Pat. No. 6,443,570 by Chu et al., granted Sep. 3, 2002 herewith entitled "Ink Jet Printing Method";

Ser. No. 09/943,952 by Sadasivan et al., filed Aug. 31, 2001 herewith entitled "Ink Jet Recording Element"; U.S. Pat. No. 6,447,110 by Chu et al., granted Sep. 10, 2002 herewith entitled "Ink Jet Printing Method";

Ser. No. 09/943,957 by Sadasivan et al., filed Aug. 31, 2001 herewith entitled "Ink Jet Recording Element"; Ser. No. 09/945,035 by Gallo et al., filed Aug. 31, 2001 herewith entitled "Ink Jet Printing Method"; Ser. No. 09/944,971 by Sadasivan et al., filed Aug. 31, 2001 herewith entitled "Ink Jet Recording Element"; and U.S. Pat. No. 6,431,701 by Gallo et al., granted Aug. 13, 2002 herewith entitled "Ink Jet Printing Method".

FIELD OF THE INVENTION

This invention relates to an ink jet recording element. More particularly, this invention relates to an ink jet recording element containing a multiplicity of particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

It is well known that in order to achieve and maintain photographic-quality images on such an image-recording element, an inkjet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An inkjet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image recording elements for use with ink jet printing are known, there are many unsolved problems in the art and many deficiencies in the known products which have severely limited their commercial usefulness. A major challenge in the design of a porous image-recording layer is to be able to obtain good quality, crack-free coatings with as little non-particulate matter as possible. If too much non-particulate matter is present, the image-recording layer will not be porous and will exhibit poor ink dry times.

EPA 813,978 A1 relates to an ink jet recording element wherein an ink absorption layer is used comprising fine particles, a hydrophilic binder and oil drops. However, there is a problem with this element in that the oil drops will migrate to the surface and cause changes in the appearance of the image.

U.S. Pat. No. 6,197,381 B1 relates to the production of a recording sheet from a coating composition comprising fine inorganic particles, a hydrophilic binder and a hydrophobic latex having a glass transition temperature of not more than 30° C. However, there is a problem with this recording sheet in that it exhibits poor ink dry times.

Final Program and Proceedings of IS&T NIP14, pp. 150–152, relates to microporous paper having an image-receiving layer comprising inorganic core/organic shell particles. The organic shells are cationic polymers. However, there is no reference to the properties or identities of the cationic polymers.

It is an object of this invention to provide a porous ink jet recording element that has good coating quality, especially reduced cracking. It is another object of this invention to provide an ink jet recording element that exhibits good image quality, especially reduced coalescence, when printed.

SUMMARY OF THE INVENTION

These and other objects are achieved in accordance with the invention, which comprises an porous ink jet recording element comprising a support having thereon an image-receiving layer comprising:

(a) inorganic particles having a primary particle size of from about 7 to about 40 nm in diameter which may be aggregated up to about 500 nm;

(b) colloidal particles having a mean particle size of from about 20 to about 500 nm;

(c) water-insoluble, cationic, polymeric particles comprising at least about 20 mole percent of a cationic mordant moiety; and (d) inorganic particles encapsulated with an organic polymer having a Tg of less than about 100° C.

The porous inkjet recording element of the invention has good coating quality and image quality when printed.

DETAILED DESCRIPTION OF THE INVENTION

Examples of (a) inorganic particles useful in the invention include alumina, boehmite, clay, calcium carbonate, titania, calcined clay, aluminosilicates, silica or barium sulfate. The particles may be porous or nonporous. In a preferred embodiment of the invention, the (a) inorganic particles are metallic oxides, preferably fumed. Preferred examples of fumed metallic oxides which may be used include fumed silica and fumed alumina. Fumed oxides are available in dry form or as dispersions of the aggregates.

While many types of inorganic particles are manufactured by various methods and commercially available for an image-receiving layer, porosity of the image-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small so that they do not scatter visible light.

In another preferred embodiment of the invention, the (a) inorganic particles may be in the form aggregated particles. The aggregates are comprised of smaller primary particles about 7 to about 40 nm in diameter, and are aggregated up to about 500 nm in diameter. In still another preferred embodiment, the (a) inorganic particles have a mean aggregate particle size of from about 50 nm to about 200 nm.

Examples of (b) colloidal particles useful in the invention include inorganic particles such as silica, alumina, titania, zirconia, yttria, or hydrated aluminum oxide. The particles may be porous or nonporous.

In another preferred embodiment, the (b) colloidal particles may be organic particles, such as polymeric particles. Examples of organic particles useful in the invention are disclosed and claimed in U.S. Pat. No. 6,364,477, granted Apr. 2, 2002; U.S. Pat. No. 6,492,006, granted Dec. 10, 2002; U.S. Pat. No. 6,380,280, granted Apr. 30, 2002; U.S. Pat. No. 6,475,602, granted Nov. 5, 2002; U.S. Pat. No. 6,376,599, granted Apr. 23, 2002; and U.S. patent application Ser. No. 09/822,731, filed Mar. 30, 2001; the disclosures of which are hereby incorporated by reference.

The (c) water insoluble, cationic, polymeric particles comprising at least about 20 mole percent of a cationic mordant moiety useful in the invention can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyperbranched, grafted, random, blocked, or can have other polymer microstructures well known to those in the art. They also can be partially crosslinked. Examples of core/shell particles useful in the invention are disclosed and claimed in U.S. patent application Ser. No. 09/772,097, of Lawrence et al., Ink Jet Printing Method, filed Jan. 26, 2001, the disclosure of which is hereby incorporated by reference. Examples of water dispersible particles useful in the invention are disclosed and claimed in U.S. Pat. No. 6,454,404, of Lawrence et al., Ink Jet Printing Method, granted Sep. 24, 2002; and U.S. Pat. No. 6,503,608, of Lawrence et al., Ink Jet Printing Method, granted Jan. 7, 2003: the disclosures of which are hereby incorporated by reference. In a preferred embodiment, the (c) water insoluble, cationic, polymeric particles comprise at least about 50 mole percent of a cationic mordant moiety.

In another preferred embodiment of the invention, the (c) water insoluble, cationic, polymeric particles which may be used in the invention are in the form of a latex which contains a polymer having a quaternary ammonium salt moiety. In yet another preferred embodiment, the (c) water-insoluble, cationic, polymeric particles comprises a mixture of latexes containing a polymer having a (vinylbenzyl) trimethyl quaternary ammonium salt moiety and a polymer having a (vinylbenzyl)dimethylbenzyl quaternary ammonium salt moiety.

The (c) water insoluble, cationic, polymeric particles useful in the invention can be derived from nonionic, anionic, or cationic monomers. In a preferred embodiment, combinations of nonionic and cationic monomers are employed. In general, the amount of cationic monomer employed in the combination is at least about 20 mole percent.

The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters, vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitrites, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

The (c) water insoluble, cationic, polymeric particles employed in this invention can be prepared using conventional polymerization techniques including, but not limited to bulk, solution, emulsion, or suspension polymerization. In a preferred embodiment of the invention, the (c) water insoluble, cationic, polymeric particles employed have a mean particle size of from about 10 to about 500 nm.

The amount of (c) water insoluble, cationic, polymeric particles used should be high enough so that the images printed on the recording element will have a sufficiently high density, but low enough so that the interconnected pore structure formed by the aggregates is not filled.

Examples of (c) water insoluble, cationic, polymeric particles which may be used in the invention include those described in U.S. Pat. No. 3,958,995, the disclosure of which is hereby incorporated by reference. Specific examples of these polymers include:

Polymer A. Copolymer of (vinylbenzyl) trimethylammonium chloride and divinylbenzene (87:13 molar ratio)

Polymer B. Terpolymer of styrene, (vinylbenzyl) dimethylbenzylamine and divinylbenzene (49.5:49.5:1.0 molar ratio)

Polymer C. Terpolymer of butyl acrylate, 2-aminoethylmethacrylate hydrochloride and hydroxyethylmethacrylate (50:20:30 molar ratio)

Polymer D. Copolymer of styrene, dimethylacrylamide, vinylbenzylimidazole and 1-vinylbenzyl-3-hydroxyethylimidazolium chloride (40:30:10:20 molar ratio)

Polymer E. Copolymer of styrene, 4-vinylpyridine and N-(2-hydroxyethyl)-4-vinylpyridinium chloride (30:38:32 molar ratio)

Polymer F. Copolymer of styrene, (vinylbenzyl) dimethyloctylammonium chloride), isobutoxymethyl acrylamide and divinylbenzene (40:20:34:6 molar ratio)

The (d) encapsulated particles used in the invention may be prepared by silane coupling chemistry to modify the surface of inorganic particles, followed by emulsion polymerization which can be found in "Emulsion Polymerization and Emulsion Polymers", edited by P. A. Lovell and M. S. El-Aassar, John Wiley and Sons, 1997.

Silane coupling agents useful for the modification of inorganic colloids include 3-aminopropyltriethoxysilane, 3-aminopropyltrimethoxysilane, 3-aminopropyldiethoxymethylsilane, 3-aminopropyldimethoxymethylsilane, 3-aminopropylethoxydimethylsilane, 3-aminopropylmethoxydimethylsilane, N-(2-aminoethyl)-3-aminopropyltrimethoxysilane, N-(2-aminoethyl)-3-aminopropyltriethoxysilane, N-(2-aminoethyl)-3-aminopropylmethyl dimethoxysilane, N-(2-aminoethyl)-3-aminopropylmethyldiethoxysilane, 4-aminobutyltriethoxysilane, 4-aminobutyltrimethoxysilane, N-(2-aminoethyl)-3-aminoisobutylmethyldimethoxysilane, and other silane coupler agents listed in Gelest catalogue, pp. 105–259(1997). Most preferred silane coupling agents for the modification of inorganic colloids used in the invention include 3-aminopropyl-triethoxysilane, 3-aminopropyltrimethoxysilane, 3-aminopropyldiethoxymethylsilane, 3-aminopropyldimethoxymethylsilane, N-(2-aminoethyl)-3-aminopropyltrimethoxysilane, N-(2-aminoethyl)-3-aminopropyltriethoxysilane, N-(2-aminoethyl)-3-aminopropylmethyldimethoxysilane, N-(2-aminoethyl)-3-aminopropylmethyldiethoxysilane.

Another way to prepare encapsulated particles useful in the invention is to directly couple organic polymer to the surface of the inorganic particles without the use of a coupling agents. In another way is to polymerize monomers in the presence of the inorganic particles. Another way is to adsorb the organic polymer on the surface of the inorganic particles.

The organic polymer used for encapsulation of the inorganic particles employed in the invention has a Tg of less than about 100° C. preferably from about −50° C. to about 65° C. Methods for determining Tg values of the organic polymers are described in "Introduction to Physical Polymer Science", 2nd Edition by L. H. Sperling, published by John Wiley & Sons, Inc., 1992. For each of the organic polymers in Table 1, the Tg value was calculated as the weighted sum of the Tg values for homopolymers derived from each of the individual monomers, i, that make up the polymer:

$$Tg = \sum_i W_i X_i$$

where W is the weight percent of monomer i in the organic polymer, and X is the Tg value for the homopolymer derived from monomer i. Tg values for the homopolymers were taken from "Polymer Handbook", 2nd Edition by J. Brandrup and E. H. Immergut, Editors, published by John Wiley & Sons, Inc., 1975.

In a preferred embodiment of the invention, monomers used to prepare the organic polymers of the (d) encapsulated particles include acrylate and styrene monomers which may have a cationic, anionic, or nonionic functionality such as quaternary ammonium, pyridinium, imidazolium, sulfonate, carboxylate or phosphonate groups. Examples of useful monomers include: n-butyl acrylate, n-ethylacrylate, 2-ethylhexylacrylate, methoxyethylacrylate, methoxyethoxy-ethylacrylate, ethoxyethylacrylate, ethoxyethoxyethylacrylate, 2-ethylhexyl-methacrylate, n-propylacrylate, hydroxyethylacrylate, etc. and cationic monomers such as a salt of trimethylammoniumethyl acrylate and trimethylammoniumethyl methacrylate, a salt of triethylammoniumethyl acrylate and triethylammoniumethyl methacrylate, a salt of dimethylbenzylammoniumethyl acrylate and dimethylbenzylammoniumethyl methacrylate, a salt of dimethylbutylammonium-ethyl acrylate and dimethylbutylammoniumethyl methacrylate, a salt of dimethylhexylammoniumethyl acrylate and dimethylhexylammoniumethyl methacrylate, a salt of dimethyloctylammoniumethyl acrylate and dimethyloctylammoniumethyl methacrylate, a salt of dimethyldodeceylammoniumethyl acrylate and dimethyldocecyl-ammoniumethyl methacrylate, a salt of dimethyloctadecyl-ammoniumethyl acrylate and dimethyloctadecyl-ammoniumethyl methacrylate, etc. Salts of these cationic monomers which can be used include chloride, bromide, methylsulfate, triflate, etc.

Examples of the organic polymers which can be used to prepare the (d) particles used in the invention include poly(n-butylacrylate-co-vinylbenzyltrimethylammonium chloride), poly(n-butylacrylate-co-vinylbenzyltrimethylammonium bromide), poly(n-butylacrylate-co-vinylbenzyltrimethylammonium chloride) and poly(n-butylacrylate-co-vinylbenzyldimethyloctadecylammonium chloride). In a preferred embodiment of the invention, the polymer can be poly(n-butyl acrylate), poly(2-ethylhexyl acrylate), poly (methoxyethylacrylate), poly(ethoxy-ethylacrylate), poly(n-butylacrylate-co-trimethylammoniumethyl acrylate methylsulfate), poly(n-butylacrylate-co-trimethylammoniumethyl methacrylate methylsulfate) or poly(n-butylacrylate-co-vinylbenzyltrimethylammonium chloride).

Any weight ratio of inorganic particle to organic polymer in the (d) encapsulated particles may be used. In a preferred embodiment, the weight ratio of inorganic particle to organic polymer is from about 20 to about 0.2.

Following are examples of inorganic particles encapsulated with an organic polymer which can be used in the invention:

TABLE 1

| Encapsulated Particle | Inorganic Particle, A | Organic Polymer, B | Tg of B (° C.) | Ratio of A/B |
|---|---|---|---|---|
| 1 | Nalco ® 2329 | Poly(n-butylacrylate-co-trimethylammoniumethyl methacrylate methylsulfate) (2:1) | 1 | 5:1 |
| 2 | Nalco ® 2329 | Poly(ethyl methacrylate-co-butyl methacrylate-co-trimethylammoniumethyl methacrylate methylsulfate) (1:1:1) | 44 | 3.8:1 |
| 3 | Nalco ® 2329 | Poly(ethyl methacrylate-co-trimethylammoniumethyl methacrylate methylsulfate) (2:1) | 58 | 3.8:1 |
| 4 | Nalco ® 2329 | Poly(n-butylacrylate-co-trimethylammoniumethyl methacrylate methylsulfate) (1:1) | 12 | 1:1 |
| 5 | Nalco ® 2329 | Poly(n-butylacrylate-co- | 12 | 2:1 |

TABLE 1-continued

| Encapsulated Particle | Inorganic Particle, A | Organic Polymer, B | Tg of B (° C.) | Ratio of A/B |
|---|---|---|---|---|
| | | trimethylammoniumethyl methacrylate methylsulfate) (1:1) | | |
| 6 | Nalco ® 2329 | Poly(n-butylacrylate-co-trimethylammoniumethyl methacrylate methylsulfate) (1:1) | 12 | 9:1 |
| 7 | Nalco ® 2329 | Poly n-butylacrylate | −20 | 4:1 |
| 8 | Ludox ® Cl | Poly(n-butylacrylate-co-trimethylammoniumethyl methacrylate methylsulfate) (2:1) | 1 | 5:1 |
| 9 | Snowtex ® OL | Poly(n-butylacrylate-co trimethylammoniumethyl methacrylate methylsulfate) (2:1) | 1 | 5:1 |

In a preferred embodiment of the invention, the (a) inorganic present in an amount of from about 10 to about 50 weight % of the image receiving layer, the (b) colloidal particles are present in an amount of from about 50 about 80 weight % of the image-receiving layer, the (c) water-insoluble, cationic, polymeric particles are present in an amount of from about 5 to about 30 weight % of the image-receiving layer; and the (d) inorganic particles encapsulated with an organic polymer are present in an amount of from about 2 to about 50 weight % of the image-receiving layer.

The image-receiving layer may also contain a polymeric binder in an amount insufficient to alter the porosity of the porous receiving layer. In a preferred embodiment, the polymeric binder is a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In another preferred embodiment of the invention, the hydrophilic polymer is poly(vinyl alcohol), hydroxypropyl cellulose, hydroxypropyl methyl cellulose, gelatin, or a poly(alkylene oxide). In still another preferred embodiment, the hydrophilic binder is poly(vinyl alcohol). In yet still another preferred embodiment, the polymeric binder is a low Tg latex such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc. The polymeric binder should be chosen so that it is compatible with the aforementioned particles.

The amount of binder used should be sufficient to impart cohesive strength to the inkjet recording element, but should also be minimized so that the interconnected pore structure formed by the aggregates is not filled in by the binder. In a preferred embodiment of the invention, the binder is present in an amount of from about 5 to about 20 weight %.

The thickness of the image-receiving layer may range from about 5 to about 40 $\mu$m, preferably from about 10 to about 20 $\mu$m. The coating thickness required is determined through the need for the coating to act as a sump for absorption of ink solvent and the need to hold the ink near the coating surface In addition to the image-receiving layer, the recording element may also contain a base layer, next to the support, the function of which is to absorb the solvent from the ink. Materials useful for this layer include inorganic particles and polymeric binder.

In addition to the image-receiving layer, the recording element may also contain a layer on top of the image-receiving layer, the function of which is to provide gloss. Materials useful for this layer include sub-micron inorganic particles and/or polymeric binder.

The support for the inkjet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, Ektacolor paper made by Eastman Kodak Co. is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the image-receiving layer to the support, the surface of the support may be subjected to a corona-discharge treatment prior to applying the image-receiving layer. The adhesion of the image-receiving layer to the support may also be improved by coating a subbing layer on the support. Examples of materials useful in a subbing layer include halogenated phenols and partially hydrolyzed vinyl chloride-co-vinyl acetate polymer.

The coating composition can be coated either from water or organic solvents, however water is preferred. The total solids content should be selected to yield a useful coating thickness in the most economical way, and for particulate coating formulations, solids contents from 10–40 wt. % are typical.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

The coating composition may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 μm, preferably from about 5 to about 40 μm.

After coating, the ink jet recording element may be subject to calendering or supercalendering to enhance surface smoothness. In a preferred embodiment of the invention, the ink jet recording element is subject to hot soft-nip calendering at a temperature of about 65° C. and a pressure of 14000 kg/m at a speed of from about 0.15 m/s to about 0.3 m/s.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Synthesis of Encapsulated Particle 1 Employed in the Invention 60 dry g of Nalco® 2329 colloidal silica as a 40 wt. % solution and 150 g of distilled water were mixed in a 500 mL 3-neck round bottom flask equipped with a mechanical stirrer and nitrogen inlet. 3 g of 3-aminopropylmethyldiethoxysilane was added over one min. The pH of the mixture was adjusted slowly to 4.0 with 1N HCl. The viscosity of the dispersion increased first in the beginning but reduced again with the addition of acid. 1.2 g of cetyltrimethylammonium bromide (CTAB) and 0.6 g of Triton X-100® were added. The dispersion was stirred one hour at room temperature.

The solution was heated to 80° C. in a constant temperature bath and purged with nitrogen for 30 min. 0.12 g of 2,2' azobis(2-methylpropionamidine) dihydrochloride was added to the reactor. A monomer emulsion comprising 8 g of n-butyl acrylate, 5 g of trimethylammoniumethyl methacrylate methylsulfate (80% solid), 0.24 g of CTAB, 0.12 g of 2,2' azobis(2-methylpropionamidine) dihydrochloride, and 40 g of deionized water was fed to the reactor over one hour to encapsulate the Nalco® 2329. The resulting dispersion was 40 wt. % solids.

Synthesis of Encapsulated Particle 2 Employed in the Invention 45 g of Nalco® 2329 colloidal silica as a 40 wt. % solution and 150 g of distilled water were mixed in a 500 mL 3-neck round bottom flask equipped with a mechanical stirrer and nitrogen inlet. 3.0 g of 3-aminopropylmethyldiethoxysilane was added over one min. The pH of the mixture was adjusted slowly to 4.0 with 1N HCl. The viscosity of the dispersion increased first in the beginning but reduced again with the addition of acid. 1.2 g of CTAB and 0.6 g of Triton X-100® were added. The dispersion was stirred one hour at room temperature.

The solution was heated to 80° C. in a constant temperature bath and purged with nitrogen for 30 min. 0.12 g of 2,2'azobis(2-methylpropionamidine) dihydrochloride was added to the reactor. A monomer emulsion comprising 4 g of ethyl methacrylate, 4 g of butyl methacrylate, 5 g of trimethylammoniumethyl methacrylate methylsulfate (80% solid), 0.24 g of CTAB, 0.12 g of 2,2'azobis(2-methylpropionamidine) dihydrochloride, and 40 g of deionized water was fed to the reactor over one hour to encapsulate the Nalco® 2329. The resulting dispersion was 19.8 wt. % solids.

Synthesis of Encapsulated Particle 3 Employed in the Invention 45 g of Nalco® 2329 colloidal silica as a 40 wt. % solution and 150 g of distilled water were mixed in a 500 mL 3-neck round bottom flask equipped with a mechanical stirrer and nitrogen inlet. 3 g of 3-aminopropylmethyldiethoxysilane was added over one min. The pH of the mixture was adjusted slowly to 4.0 with 1N HCl. The viscosity of the dispersion increased first in the beginning but reduced again with the addition of acid. 1.2 g of CTAB and 0.6 g of Triton X-100® were added. The dispersion was stirred one hour at room temperature.

The solution was heated to 80° C. in a constant temperature bath and purged with nitrogen for 30 min. 0.12 g of 2,2'azobis(2-methylpropionamidine) dihydrochloride was added to the reactor. A monomer emulsion comprising 8 g of ethyl methacrylate, 5 g of trimethylammoniumethyl methacrylate methylsulfate (80% solid), 0.24 g of CTAB, 0.12 g of 2,2'azobis(2-methylpropionamidine) dihydrochloride, and 40 g of deionized water was fed to the reactor over one hour to encapsulate the Nalco® 2329. The resulting dispersion was 19.9 wt. % solids.

Element 1 of the Invention

A coating solution for a base layer was prepared by mixing 254 dry g of precipitated calcium carbonate Albagloss-s® (Specialty Minerals Inc.) as a 70% solution, 22 dry g of silica gel Gasil® 23F (Crosfield Ltd.), 2.6 dry g of poly(vinyl alcohol) Airvol® 125 (Air Products) as a 10% solution, 21 dry g of styrene-butadiene latex CP692NA® (Dow Chemicals) as a 50% solution and 0.8 g of Alcogum® L-229 (Alco Chemicals). The solids of the coating solution was adjusted to 35 wt. % by adding water. The base layer coating solution was bead-coated at 25° C. on Ektacolor Edge Paper (Eastman Kodak Co.) and dried by forced air at 60° C. The thickness of the base layer was 25 $\mu$m or 27 g/m$^2$.

A coating solution for the image receiving layer was prepared by mixing 15.0 dry g of alumina Dispalt® 14N4-80 (Condea Vista) as 20 wt. % solution, 2.4 dry g of fumed alumina Cab-O-Sperse® PG003 (Cabot Corp.) as a 40 wt. % solution, 0.6 dry g of poly(vinyl alcohol) Gohsenol® GH-17 (Nippon Gohsei Co. Ltd.) as a 10 wt. % solution, 1.2 dry g of a copolymer of (vinylbenzyl)trimethylammonium chloride and divinylbenzene (87:13 molar ratio) as a 20 wt. % solution, 1.2 dry g of a terpolymer of styrene, (vinylbenzyl) dimethylbenzylamine and divinylbenzene (49.5:49.5:1.0 molar ratio) as a 20 wt. % solution, 0.9 dry g of Encapsulated Particles 1 as a 40 wt. % solution, 0.1 g of Silwet® L-7602 (Witco. Corp.), 0.2 g of Silwet® L-7230 (Witco. Corp.) and water to total 153 g.

The image-receiving layer coating solution was bead-coated at 25° C. on top of the base layer described above. The recording element was then dried by forced air at 60° C. for 80 seconds followed by 38° C. for 8 minutes. The thickness of the image-receiving layer was 8 $\mu$m or 8.6 g/m$^2$.

Element 2 of the Invention

This element was prepared the same as Element 1 except that 1.0 dry g of Encapsulated Particles 2 as a 19.8 wt. % solution was used instead of Encapsulated Particles 1.

Element 3 of the Invention

This element was prepared the same as Element 1 except that 1.0 dry g of Encapsulated Particles 3 as a 19.9 wt. % solution was used instead of Encapsulated Particles 1.

Synthesis of Comparative Encapsulated Particles 1

60 dry g of Nalco® 2329 colloidal silica as a 40 wt. % solution and 150 g of distilled water were mixed in a 500 mL 3-neck round bottom flask equipped with a mechanical stirrer and nitrogen inlet. 3.0 g of 3-aminopropylmethyldiethoxysilane was added over one min. The pH of the mixture was adjusted slowly to 4.0 with 1N HCl. The viscosity of the dispersion increased first in the beginning but reduced again with the addition of acid. 1.2 g of CTAB and 0.6 g of Triton X-100® were added. The dispersion was stirred one hour at room temperature.

The solution was heated to 80° C. in a constant temperature bath and purged with nitrogen for 30 min. 0.12 g of 2,2'azobis(2-methylpropionamidine) dihydrochloride was added to the reactor. A monomer emulsion comprising 12.7 g of methyl methacrylate, 0.26 g of ethyleneglycol dimethacrylate, 0.24 g of CTAB, 0.12 g of 2,2'azobis(2-methylpropionamidine) dihydrochloride, and 40 g of deionized water was fed to the reactor over one hour to encapsulate the Nalco® 2329. The resulting dispersion was 19.9 wt. % solids.

The Tg of these particles is about 110° C. This value is obtained by adding 5° C. to the Tg value of the homopolymer derived from methyl methacrylate in order to account for the presence of the small amount of ethyleneglycol dimethacrylate.

Synthesis of Comparative Encapsulated Particles 2

60 dry g of Nalco® 2329 colloidal silica as a 40 wt. % solution and 150 g of distilled water were mixed in a 500 mL 3-neck round bottom flask equipped with a mechanical stirrer and nitrogen inlet. 3.0 g of 3-aminopropylmethyldiethoxysilane was added over one min. The pH of the mixture was adjusted slowly to 4.0 with 1N HCl. The viscosity of the dispersion increased first in the beginning but reduced again with the addition of acid. 1.2 g of CTAB and 0.6 g of Triton X-100® were added. The dispersion was stirred one hour at room temperature.

The solution was heated to 80° C. in a constant temperature bath and purged with nitrogen for 30 min. 0.12 g of 2,2'azobis(2-methylpropionamidine) dihydrochloride was added to the reactor. A monomer emulsion comprising 8 g of methyl methacrylate, 5 g of trimethylammoniumethyl methacrylate methylsulfate (80% solid), 0.24 g of CTAB, 0.12 g of 2,2'azobis(2-methylpropionamidine) dihydrochloride, and 40 g of deionized water was fed to the reactor over one hour to encapsulate the Nalco® 2329. The resulting dispersion was 19.1 wt. % solids.

The Tg of these particles is about 110° C.

Comparative Element 1

This element was prepared the same as Element 1 except that 1.0 dry g of Comparative Encapsulated Particles 1 as a 19.9 wt. % solution was used instead of Encapsulated Particles 1.

Comparative Element 2

This element was prepared the same as Element 1 except that 0.9 dry g of Comparative Encapsulated Particles 2 as a 19.1 wt. % solution was used instead of Encapsulated Particles 1.

Coating Quality

The above dried coatings for visually evaluated for cracking defects. The results are tabulated in Table 2.

TABLE 2

| Recording Element | Coating Quality |
|---|---|
| 1 | No cracking |
| 2 | No cracking |
| 3 | No cracking |
| Comparative 1 | Some cracking |
| Comparative 2 | Cracking |

The above results show that excellent coating quality, especially no cracking, is observed with the recording elements of the invention as compared to the comparative recording elements.

Image Quality & Dry Time

An Epson Stylus Color 740 printer for dye-based inks using Color Ink Cartridge S020191/IC3CL01 was used to print on the recording elements. The image consisted of adjacent patches of cyan, magenta, yellow, black, green, red and blue patches, each patch being in the form of a rectangle 0.4 cm in width and 1.0 cm in length. Bleed between adjacent color patches was qualitatively assessed. A second image was printed, and immediately after ejection from the printer, the image was wiped with a soft cloth. The ability of each recording element to dry quickly was qualitatively assessed. Results are shown in Table 3.

TABLE 3

| Recording Element | Image Quality | Dry Time |
|---|---|---|
| 1 | Little bleeding | Instant |
| 2 | Little bleeding | Instant |
| 3 | Little bleeding | Instant |
| Comparative 1 | Considerable bleeding | Instant |
| Comparative 2 | Considerable bleeding | Instant |

The above table shows that the recording elements of the invention have good image quality and instant dry time.

This invention has been described with particular reference to preferred embodiments thereof but it will be understood that modifications can be made within the spirit and scope of the invention.

What is claimed is:

1. A porous ink jet recording element comprising a support having thereon an image-receiving layer comprising:

(a) inorganic particles having a primary particle size of from about 7 to about 40 nm in diameter which may be aggregated up to about 500 nm;

(b) colloidal particles having a mean particle size of from about 20 to about 500 nm;

(c) water-insoluble, cationic, polymeric particles comprising at least about 20 mole percent of a cationic mordant moiety; and (d) inorganic particles encapsulated with an organic polymer having a Tg of less than about 100° C.

2. The recording element of claim 1 wherein said (a) inorganic particles are fumed silica or fumed alumina.

3. The recording element of claim 1 wherein said (b) colloidal particles are silica, alumina, titania, zirconia, yttria, or hydrated aluminum oxide.

4. The recording element of claim 1 wherein said (b) colloidal particles are organic particles.

5. The recording element of claim 1 wherein said (c) water-insoluble, cationic, polymeric particles are in the form of a latex which contains a polymer having a quaternary ammonium salt moiety.

6. The recording element of claim 1 wherein said (c) water-insoluble, cationic, polymeric particles comprises a mixture of latexes containing a polymer having a (vinylbenzyl)trimethyl quaternary ammonium salt moiety and a polymer having a (vinylbenzyl)dimethylbenzyl quaternary ammonium salt moiety.

7. The recording element of claim 1 wherein said (c) water-insoluble, cationic, polymeric particles have a mean particle size of from about 10 to about 500 nm.

8. The recording element of claim 1 wherein said (d) inorganic particles encapsulated with an organic polymer have a mean particle size of from about 5 nm to about 1000 nm.

9. The recording element of claim 1 wherein the Tg of said organic polymer used to make said encapsulated (d) particles is from about 50° C. to about 65° C.

10. The recording element of claim 1 wherein said organic polymer used to make said encapsulated (d) particles is derived from a cationic, anionic or nonionic monomer.

11. The recording element of claim 10 wherein said monomer contains a quaternary ammonium, pyridinium, imidazolium, sulfonate, carboxylate or phosphonate functionality.

12. The recording element of claim 1 wherein said organic polymer used to make said encapsulated (d) particles is derived from an acrylate- or styrene-containing monomer.

13. The recording element of claim 1 wherein said (d) inorganic particles are encapsulated by polymerizing a monomer in the presence of said inorganic particles to form said organic polymer.

14. The recording element of claim 1 wherein said (d) inorganic particles are encapsulated with said organic polymer by:

(a) modifying the surface of said inorganic particles with a silane-containing material; and (b) polymerizing a monomer to form said organic polymer.

15. The recording element of claim 1 wherein said (d) inorganic particles are encapsulated with said organic polymer by adsorption of said organic polymer onto the surface of said inorganic particles.

16. The recording element of claim 1 wherein said (d) inorganic particles are encapsulated with said organic polymer by chemical bond formation between said inorganic particles and said organic polymer.

17. The recording element of claim 1 wherein the weight ratio of said inorganic particles to said organic polymer in said (d) particles is from about 20 to about 0.2.

18. The recording element of claim 1 wherein said (a) inorganic particles are present in an amount of from about 10 to about 50 weight % of said image-receiving layer, said (b) colloidal particles are present in an amount of from about 50 to about 80 weight % of said image-receiving layer, said (c) water-insoluble, cationic, polymeric particles are present in an amount of from about 5 to about 30 weight % of said image-receiving layer; and said (d) inorganic particles encapsulated with an organic polymer are present in an amount of from about 2 to about 50 weight % of said image-receiving layer.

19. The recording element of claim 1 wherein a base layer comprising at least about 50% by weight of inorganic particles is coated between said support and said image-receiving layer.

20. The recording element of claim 1 wherein said image-receiving layer also contains a binder in an amount of from about 5 to about 20 weight %.

* * * * *